US006237804B1

(12) United States Patent
Peery et al.

(10) Patent No.: US 6,237,804 B1
(45) Date of Patent: May 29, 2001

(54) PILL DISPENSING APPARATUS

(76) Inventors: Van Collin Peery, 645 S. 1000 West; Gregory Mark Peery, 647 1030 West, both of Orem, UT (US) 84058

( * ) Notice: Subject to any disclaimer, the term of this patent is extended or adjusted under 35 U.S.C. 154(b) by 0 days.

(21) Appl. No.: 09/312,983

(22) Filed: May 17, 1999

(51) Int. Cl.[7] ..... G07F 11/00; G07F 11/46; A24F 15/04

(52) U.S. Cl. ..... 221/7; 221/186; 221/152; 221/190

(58) Field of Search ..... 221/186, 190, 221/200, 201, 202, 204, 209, 233, 7, 251, 236

(56) References Cited

U.S. PATENT DOCUMENTS

| | | | | |
|---|---|---|---|---|
| 3,601,250 | | 8/1971 | Merila | 206/42 |
| 3,622,041 | * | 11/1971 | Borsum | 221/202 X |
| 3,730,387 | | 5/1973 | McConnell et al. | 221/265 |
| 3,833,147 | * | 9/1974 | Borsum et al. | 221/202 |
| 3,863,804 | * | 2/1975 | Infante-Diaz et al. | 221/251 X |
| 3,991,908 | | 11/1976 | Thomas et al. | 221/154 |
| 4,124,143 | | 11/1978 | Thomas | 221/82 |
| 4,432,300 | | 2/1984 | Lyss | 116/308 |
| 4,457,451 | * | 7/1984 | Ichikawa | 221/190 X |
| 4,854,478 | | 8/1989 | Gyimothy | 221/190 |
| 4,913,315 | * | 4/1990 | Wagner | 221/200 X |
| 5,366,113 | | 11/1994 | Kim et al. | 221/232 |
| 5,865,342 | * | 2/1999 | Ito et al. | 221/265 X |
| 5,934,505 | * | 8/1999 | Shimada | 221/236 X |
| 6,062,423 | * | 5/2000 | Saito et al. | 221/236 X |

* cited by examiner

*Primary Examiner*—Christopher P. Ellis
*Assistant Examiner*—Gene O. Crawford
(74) *Attorney, Agent, or Firm*—Workman, Nydegger & Seeley

(57) ABSTRACT

A pill dispensing apparatus for delivering pills, comprising a housing formed to cooperate with a container. An agitator having a passageway formed therethrough and being in slidable engagement with the housing. The agitator is configured to move the pills within the container into the passageway upon vertical displacement of the agitator into the container. In communication with the housing and the agitator is an escapement member. The escapement member is formed to move generally laterally to the passageway and to allow at least one pills to exit from the passageway as the agitator slidable engages with the housing.

43 Claims, 8 Drawing Sheets

PILL DISPENSING APPARATUS

BACKGROUND OF THE INVENTION

1. The Field of the Invention

The present invention relates to an apparatus for dispensing pills in a variety of forms. More particularly, the present invention is directed to a pill dispensing apparatus that can deliver one or more herbal and nutritional supplements, medicaments, or drugs in a pill form.

2. Present State of the Art

With the advances in technology in recent years, and more specifically in the fields of pharmaceutical medicaments, medical techniques, and herbal and nutritional supplements the life expectancy of individuals is steadily increasing. The causes of this increase results from various social, economic, and technological factors that combine to allow an individual to have a longer and more fulfilling life and life style. One significant factor for increasing the life expectancy of many individuals is the availability of pharmaceutical medicaments, herbal supplements, and nutritional supplements that combat disease and some effects of aging.

In order for an individual to obtain the beneficial effects of the pharmaceutical medicaments and the herbal and nutritional supplements it is necessary to provide a sufficient quantity of the medicament or supplement in a controlled manner. Various types of delivery devices have been developed to allow an individual, whether a patient, physician, nurse, pharmacist, or the like to count and deliver the required dosage of the medicament or supplement.

One common type of tablet dispenser is configured for home-use by the elderly or motor-impaired patients. The pill dispenser allows a user to push downwardly upon a housing that activates a mechanism to discharge a pill from the end thereof. The housing includes a supply space for holding a quantity of the medicament. Communicating with the supply space is an interior element that directs the pills within the supply space towards the end of the housing. The interior elements in cooperation with the housing prevent excessive delivery of medicaments or supplements. Unfortunately, if an individual requires multiple pills a significant amount of time is needed to activate the dispenser many times. Additionally, many home-use dispensers are formed with various interlocking component parts and deformable elements, such as the springs, that are capable of breaking through continued use. Furthermore, some home use type devices are complicated to manufacture due to the numerous intricate and interlocking component parts.

Various pill dispensers count and dispense the necessary medicament or supplements. With the increase in the number of prescription drugs and herbal and nutritional supplements available individuals, such as pharmacists have a limited amount of time to fill and check each individual prescriptions or request. Therefore, counters enable pharmacists and others to automatically count the number of pills going into a vial or other container.

Many pill counters use sensors that detect the number of pills passing a particular location and provide an accurate account of the pills as they pass into the vials or containers. The various systems use storage bins with the desired type of pill. Some systems merely use a keypad to control the identification of the pill contained within the bins and count the pills as they fall upon a tray. Other fully automated systems employ computer systems that control the distribution of the pills from the bins, past the counter, and into the vials or containers.

Unfortunately these automated and complicated systems having a number of disadvantages. For example, there is significant cost involved with installing a computer system with the required sensors and detectors used to identify the types of pill within each individual bin. There is, additionally, a substantial amount of time required to input the requisite data for each bin, as well as the time necessary to train personnel to use the automated system. Furthermore, residues of previous pills can contaminate automatic counters resulting in possible reaction problems. Additionally, some of the automated counters are incapable of taking an accurate pill count due to broken pills or variations in the frequency of pill delivery.

Therefore, it is desirable to provide a dispenser that is capable of discharging various quantities of pills in an orderly and controllable manner. Additionally, it is desirable to provide a dispensing apparatus that is simple to manufacture and use without significant time and expense involved in training.

SUMMARY AND OBJECTS OF THE INVENTION

It is an object of one embodiment of the present invention to provide a pill dispenser that is capable of delivering varying quantities of pill.

It is another object of one embodiment of the present invention to provide a pill dispenser that is simple to operate.

It is yet another object of one embodiment of the present invention to provide a pill dispenser that is capable of being inexpensive and easily manufactured.

Another object of one embodiment of the present invention is to provide a pill dispenser that may be used in a rack type system where numerous types and quantities of medicaments or supplements may be delivered.

Yet another object of one embodiment of the present invention is provide a pill dispenser that can deliver variously sized pills.

Additional objects and advantages of the invention will be set forth in the description that follows, and in part will be obvious from the description, or may be learned by the practice of the invention. The objects and advantages of the invention may be realized and obtained by means of the instruments and combinations particularly pointed out in the appended claims.

To achieve the foregoing objects, and in accordance with the invention as embodied and broadly described herein a dispensing apparatus for delivering medicaments, drugs, vitamins, herbal and/or nutritional supplements (hereinafter "supplements") in a pill form, such as pills tablets, capsules, or the like (hereinafter "pills") is disclosed. The dispensing apparatus comprises a housing formed to cooperate with a container. In slidable engagement with the housing is an agitator that includes a passageway that passes therethrough. Upon displacement of the agitator within the housing, the pills move from within the container into the passageway. In communication with the housing and the agitator is an escapement member. The escapement member moves generally laterally to the passageway and allows one or more pills to exit from the passageway as the agitator slidably engages with the housing.

In an alternate embodiment of the present invention the escapement member is formed with a handle. The handle allows a user to move the escapement member generally laterally to the passageway, thereby allowing one or more pills to exit from the passageway.

In yet another alternate embodiment the escapement is formed within an interior chamber of the agitator. Through vertical displacement of the agitator into the container, activation of the escapement occurs resulting in a portion of the escapement being withdrawn from within the passageway to allow pills to flow therethrough.

In another alternate embodiment, a rack-type system securely retains the pill dispensing apparatus to allow easy dispensing of the pills. The rack securely retains numerous containers and pill dispensing apparatus and includes an agitating bar that allows a user to activate one or more agitators through a single motion. The rack further allows a user to control the number of pills dispensed for each pill dispensing apparatus.

In still yet another alternate embodiment the pill dispensing apparatus is formed to cooperate with a child safety lock to thereby prevent access to the pills within the container.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention provides an apparatus, system and method for dispensing medicaments, drugs, vitamins, herbal supplements, nutritional supplements, and the like in pill form. Variations in the flow of pills from the apparatus is possible from one to multiple pills as required by an individual, such as a patient or pharmacist. The pill dispensing apparatus eliminates much of the tedious nature of dispensing and counting pills before placement within a prescription vial.

Generally speaking, the pill dispensing apparatus is conformable to current drug, medicament or supplement containers that vary in size and dimension. The pill dispensing apparatus may be used in various locations and for numerous medicament dispensing requirements ranging from pharmacies, hospitals, health centers, or the like. Additionally, the pill dispensing apparatus may be used for delivery of vitamins, herbal supplements and nutritional supplements such as at health food stores, gyms, or the like. In addition to being capable of cooperating with variously sized containers, the pill dispensing apparatus is simple to use with few deformable parts, thereby reducing the possibility of breakage during use. Furthermore, the pill dispensing apparatus requires little training to use.

A pill dispensing apparatus according to the present invention includes a container for holding a particular type of pill. The container cooperates with a housing of the pill dispensing apparatus to provide the necessary pill. Attached to the housing is an agitator that includes a longitudinal passageway therethrough. The agitator is capable of promoting movement of the pills within the container into the passageway. Therefore, the agitator is one structure of agitating means for moving the pill within the container into a passageway. The agitating means is capable of being located within the container. The agitating means creates movement of the pills formed medicament from the input end to exit through the end of the passageway. In cooperation with the passageway is an escapement or escapement means for allowing one or more pills to exit from the passageway upon activation by the user. The escapement means controls the quantity of pills delivered through the passageway.

The figures and the following discussion are intended to provide a brief, general description of the pill dispensing apparatus of the present invention. The present invention will be described in the context of two particular embodiments, however, it can be appreciated that the invention may be practiced in various forms in light of the teaching contained herein.

Figure 1:
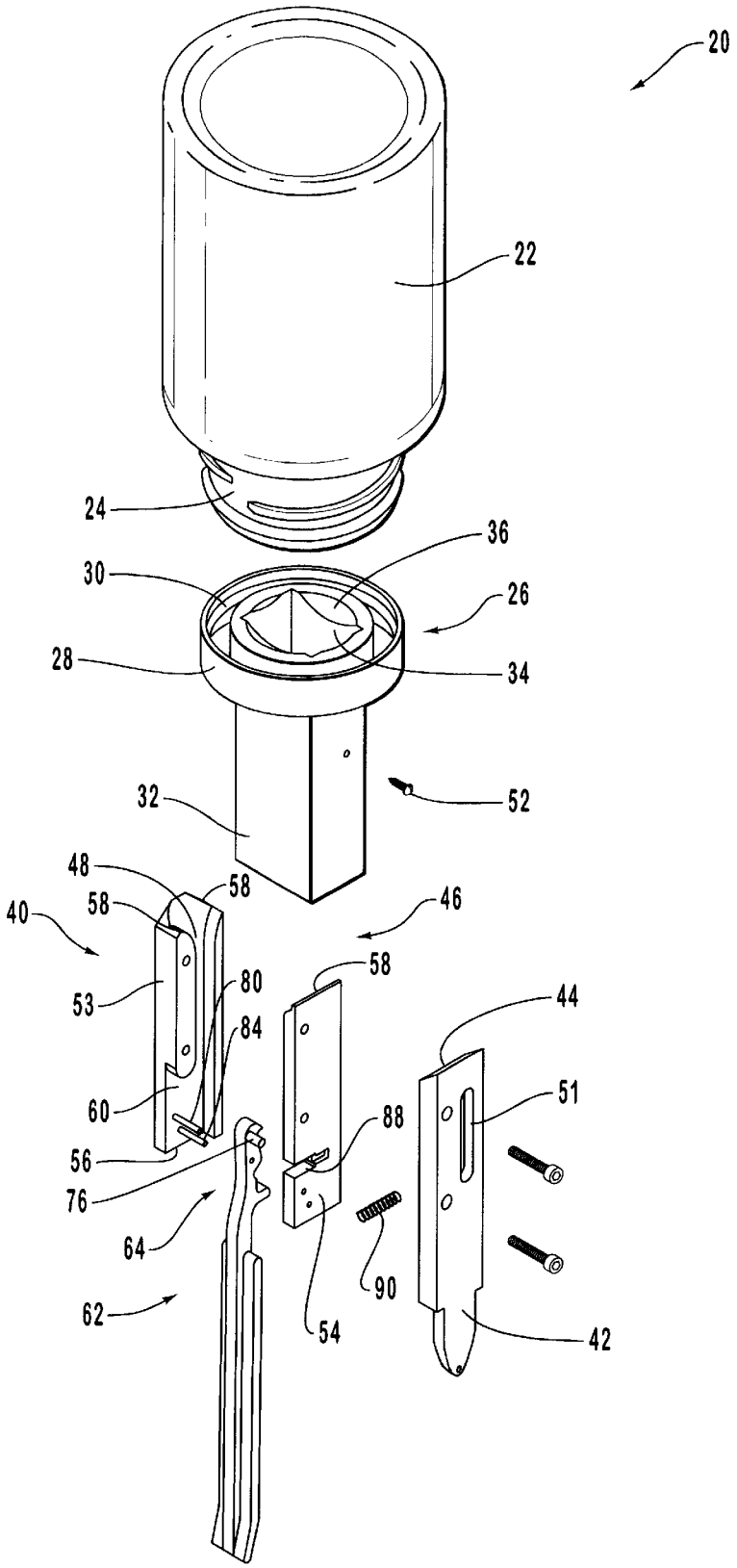
FIG. 1 is an exploded perspective view of a medicament dispensing apparatus.

Depicted in FIG. 1 is an exemplary apparatus for implementing the present invention of a pill dispensing apparatus 20. Pill dispensing apparatus 20 comprises a container 22 in cooperation with a housing 26. Container 22 is provided with a threaded portion 24 that cooperates with a threaded portion 30 formed at a first end 28 of housing 26. In view of the teaching contained herein, one skilled in the art can identify various other attachment means or mechanisms that are known by one skilled in the art.

For example, container 22 may be attached to housing 26 through a slip fit attachment. In another configuration, container 22 is integrally formed with housing 26 and provided with an opening opposite to housing 26 to allow the pills to be delivered therein. In yet another configuration, container 22 is provided with tension springs that surround first end 28 of housing 26 and are coupled to container 22 to pull container 22 into contact with first end 28. In another configuration, first end 28 includes a slot within which complementary protrusions within container 22 engage. In yet another configuration, first end 28 comprises one or more fasteners that engage with the surface, pass through, or are inserted into container 22.

Housing 26 has a second end 32 formed to cooperate with an agitator 40. As depicted in FIG. 1, second end 32 has a generally square or rectangular cross-section and is provided with a through hole 34 that extends from second end 32 to first end 28 of housing 26. First end 28 of through hole 34 is formed with a number of flanges or slanted portions 36 which cooperate with agitator 40 to allow the pills to exit from container 22, as will be discussed in greater detail hereinafter.

It can be appreciated that housing 26 can have various dimensions to cooperate with container 22 and agitator 40. For example, housing 26 may have circular, ovular, trapezoidal, triangular, or the like, cross-sections. Furthermore, the length of housing 26 may vary as necessary and known by one skilled in the art.

In general, materials that have sufficient strength and resiliency to cooperate with various fasteners form housing 26. The types of material range from metals, composites, plastics, polycarbonate, polyethylene, polypropylene.

Slidably engaged with through hole 34 of housing 26 is agitator 40. Agitator 40 comprises a displacement member 42 coupled to a dispensing member 46. Displacement member 42 is provided with an angled portion 44 at a first end 50 thereof. Angled portion 44 cooperates with flange or slanted portions 36 formed at first end 28 of housing 26 to direct pills towards dispensing member 46. As such, the angle or configuration of angled portion 44 varies to aid in the delivery of pills. Displacement member 42 is provided with a slot 51 formed on the opposite side thereof from dispensing member 46. Slot 51 cooperates with a fastener 52 such as a screw that is insert through the side of housing 26. The combination of slot 51 and fastener 52 allows control of the displacement of agitator 40 within housing 26 and therefore into container 22. As such, the length of slot 51 varies as necessary to allow different degrees of insertion of agitator 40 within housing 26. Slot 51 and fastener 52 are structures capable of performing the function of control means for controlling the displacement of the agitator 40 within container 22. It can be appreciated that various other configurations of control means are known by one skilled in the art.

For example, housing 26 can include an integrally formed nodule that extends into slot 51. In another configuration, housing 26 has a slot 51 and a protruding portion from displacement member 42 located therein. In yet another configuration, a plurality of slots 52 and fasteners 52 perform the function of control means. Fastener 52 can take various forms, such as by way of example and not limitation, screws, nuts and bolts, pins, or the like.

Dispensing member 46 has a first member 53 coupled to a second member 54. First member 53 includes a passageway 48 formed by the coupling of second member 54 thereto. Passageway 48 extends from first end 50 to a second end 56 of dispensing member 46. Both first member 53 and second member 54 have angled portions or flanges 58 at the first end 50 thereof. The combination of flanges 58 is such that dispensing member 46 has a generally conical-shaped first end 50 to direct the pills contained within container 22 into passageway 48. The specific dimension of first end 50 and flanges 58 may be varied so long as they cooperate with angled portion 44 of displacement member 42, to provide a flow of pills into passageway 48.

The second end 56 of first member 53 has a recess 60 configured to cooperated with escapement 62. Recess 60 allows escapement 62 to be fixably and rotatable attached to dispensing member 46 and allow free rotation thereof. Recess 60 has a pin 80 fixably attached to dispensing member 46 by way of an axial hole (not shown). A stop bar 84 is further provided in recess 60 to prevent unwanted rotational movement of escapement 62 during use, as shown in FIGS. 2A and 2B.

Escapement 62, as previously discussed, controls the flow of pills that exit from passageway 48.

Figure 2A:
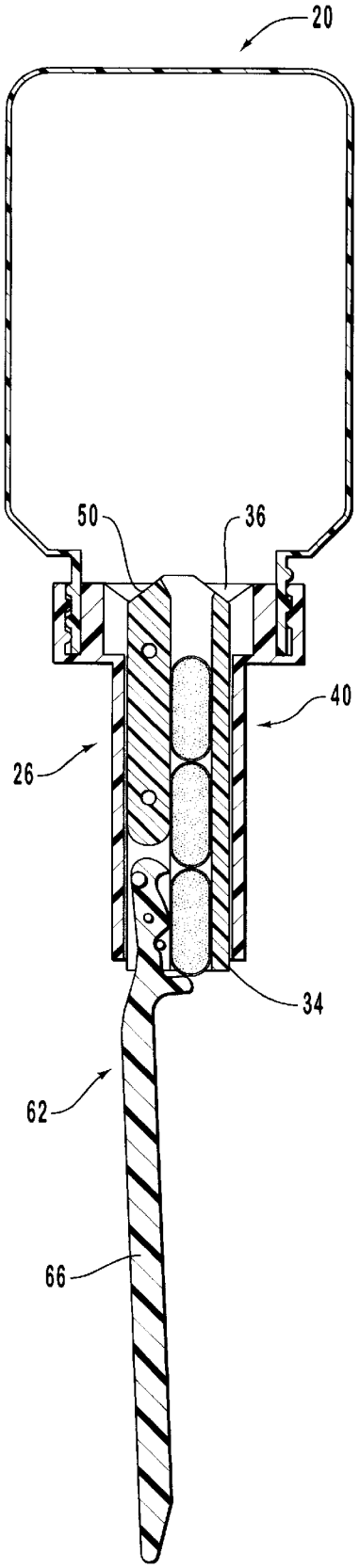
FIGS. 2A–2B are cross-sectional side views of the medicament dispensing apparatus in FIG. 1.
Figure 2B:
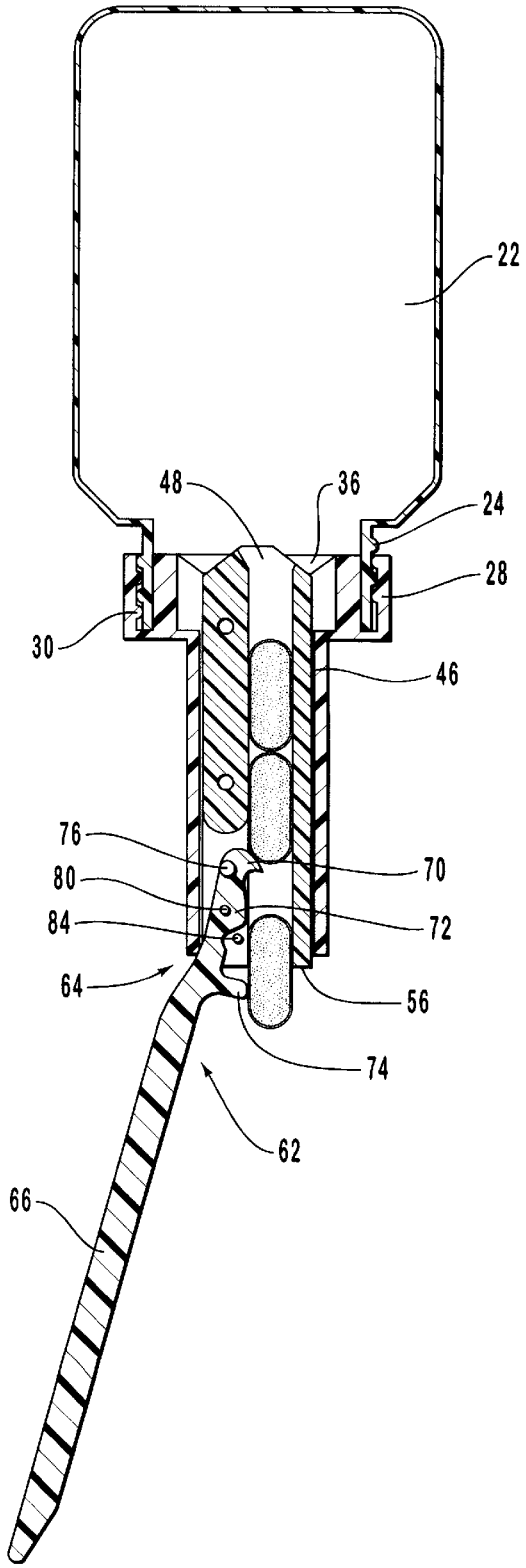

Referring now to FIGS. 2A and 2B, escapement 62 comprises a head portion 64 and a handle 66. Escapement 62 cooperates with displacement member 42, dispensing member 46, and passageway 48 to control the flow of pills that exit from passageway 48. Head portion 64 comprises a top stop portion 70, a middle portion 72, and a bottom stop portion 74. As shown in FIG. 2A, top stop portion 70 is retained within recess 60 and allows free passage of the pills, while bottom stop portion 74 prevents passage of pills from second end 56 of passageway 48. During operation of escapement 62, as shown in FIG. 2B, however, top stop portion 70 rotates about a rotation pin 80 located through middle portion 72 to enter passageway 48 and prevent the passage of pills therethrough.

Extending from top stop portion 70 is a connector portion 76. Connector portion 76 cooperates with a connector recess 88 formed in dispensing member 46. Connector recess 88, in cooperation with connector portion 76 retain a spring 90 to cause head portion 54, and more generally, escapement 62 to be biased to a closed position, as shown in FIG. 1. The closed position, as shown in FIG. 2A, occurs when bottom stop portion 74 substantially covers second end 56 of passageway 48. A stop bar 84 prevents over rotation of head portion 64 and bottom stop portion 74 as they are biased by spring 90. By biasing escapement 62 to the closed position, the pills remain within container 22 upon breakage of spring 90.

The combination of spring 90, connector recess 88, and connector portion 76 is one structure capable of performing the function of biasing means for maintaining escapement means in a closed position during non-use. One skilled in the art can identify various other structures that capable of performing the desired function.

For example, first member 53 includes connector recess 88. In another configuration, connector recess 88 is partially formed in both first member 53 and second member 54 of dispensing member 46. In still yet another configuration, connector recess 88 has multiple springs 90 and multiple connector recesses 88.

In view of the teaching contained herein, it can be appreciated that head portion 64 of escapement 62 may be variously sized and dimensioned as necessary to prevent premature delivery of the pills from passageway 48. Furthermore, variations in the configuration of top stop portion 70, middle portion 72, and bottom stop portion 74 is possible so long as the desired function is performed.

In operation of pill dispensing apparatus 20, as depicted in FIGS. 2A and 2B, a user pushes handle 66 of escapement 62 along the longitudinal axis of housing 26. As handle 66 is pushed, agitator 40 simultaneously slides along through hole 34 of housing 26. As agitator 40 enters the interior of container 22, the angled portion 44 of displacement member 42 contacts the pills contained therein. Angled portion 44 directs the pills toward the conical-shaped first end 50 of dispensing member 46, thereby filing passageway 48 with a number of pills. Once agitation of the pills has occurred, release of handle 66 results in handle 66 traversing to a position where agitator 40 is substantially not contained within container 22. Once handle 66 is thus positioned, handle 66 is manipulated tangentially to the longitudinal axis of passageway 48 thereby moving bottom stop portion 74 from the second end 56 of passageway 48 to allow the pills to be released therefrom. Simultaneously, connector portion 76 cooperates with spring 90 contained within connector recess 76 to bias head portion 64, particularly bottom stop portion 74, over second end 56 of passageway 48. Various methods of operating pill dispensing apparatus 20 are known to one skilled in the art.

For example, handle 66 need not be released before moving handle 66 tangentially to the longitudinal axis of housing 26. By so doing, agitator 40 retains within the interior of container 22 to direct the flow of pills through passageway 48.

Agitator 40 is one structure capable of performing the function of agitating means for moving the pills within the container into a passageway, the agitating means being capable of displacement within the container. In view of the teaching contained herein, one skilled in the art can identify various other structures that are capable of performing the same function as agitating means. Furthermore, escapement 62, formed with head portion 64 and handle 66, is once structure capable of performing the function of escapement means for allowing one or more pills to exit from the passageway upon activation by a user. Again, one skilled in the art can identify various other configurations of escapement 62 and escapement means.

In general, materials that form agitator 40 and escapement 62 range from plastics, composites, polycarbonate, metals, polyethylene, polypropylene, or the like.

Figure 3:
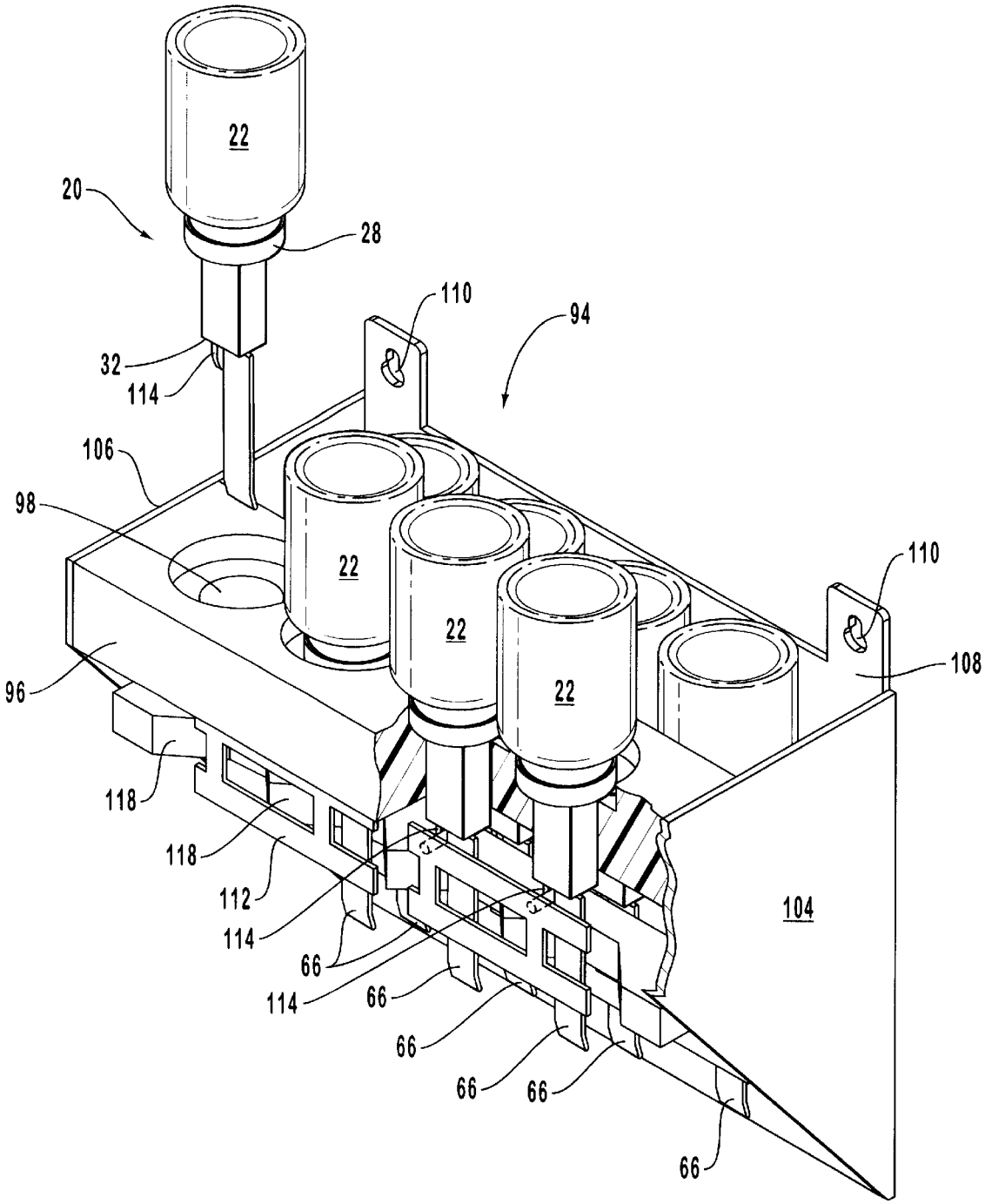
FIG. 3 is a partial cut-away exploded perspective view of a rack-type system incorporating the medicament dispensing apparatus in FIG. 1.

Depicted in FIG. 3, is a rack-type pill dispensing system incorporation pill dispensing apparatus 20. As shown, a rack 94 supports a plurality of containers 22 and a plurality of pill dispensing apparatus 20. Rack 94 has one or more generally rectangular holding portions 96 with one or more apertures 98. Apertures 98 cooperate with the plurality of containers 22 releasably attached to the plurality of pill dispensing apparatus 20. As such apertures 98 have sufficient dimensions to allow passage of second end 32 of housing 26 while preventing passage of first end 28. Therefore, first end 28 rests within apertures 98. In other configuration first end 28 has an outer male threaded portion that couples to female threads formed in holding position 96, or vice versa.

The rectangular holding portions 96 are retained in place by two side members 104 and 106 that are readily attached to a back plate 108. Back plate 108 has two attachment holes 110 that are sized to allow a fastener to pass therethrough to fixably attach rack 94 to a support, such as a wall.

The embodiment of rack 94 depicted in FIG. 3 is formed such that rectangular holding portions 96, side members 104, 106 and backplate 108 are integrally formed from a single unit. In other configurations of rack 94, the component parts may be coupled together by way of fasteners such as, by way of example and not limitation, screws, nuts and bolts, pins, adhesives, welding, sonic bonding, chemical bonding, or the like.

In this configuration, fixably attached to a cam 114 by way of holes 116 (not shown) are one or more agitating bars 112, as shown in FIGS. 1 and 3. Therefore, upon displacement of agitating bars 112, one or more agitators 40 are located within the interior of one or more containers 22. One skilled in the art knows various other configurations of agitating bars 112.

For example, agitating bars 112 may be connected to individual cam 114. In another configuration, agitating bars 112 are connected to agitators 40 by way of other means rather than cam 114 and holes 116 (not shown).

In operation, displacement of agitating bars 112 causes the pills within containers 22 to become located within passageway 48 of pill dispensing apparatus 20. Once the pills are correctly located, a vial (not shown) is position below passageway 48 against a stop 118. Simultaneously, the vial contacts handle 66 thereby moving bottom stop portion 74 to release the pills.

One skilled in the art can identify various configurations of rack 94, so long as rack 94 is capable of carrying one or more containers and one or more pill dispensing apparatus 20. For example, in an alternate configuration, a single container includes one or more pill dispensing apparatus 20. The containers having a number of threaded portions or other attaching means.

In general, the materials that have form rack 94 range from plastics, composites, polycarbonate, metals, polyethylene, polypropylene, or the like.

Figure 4:
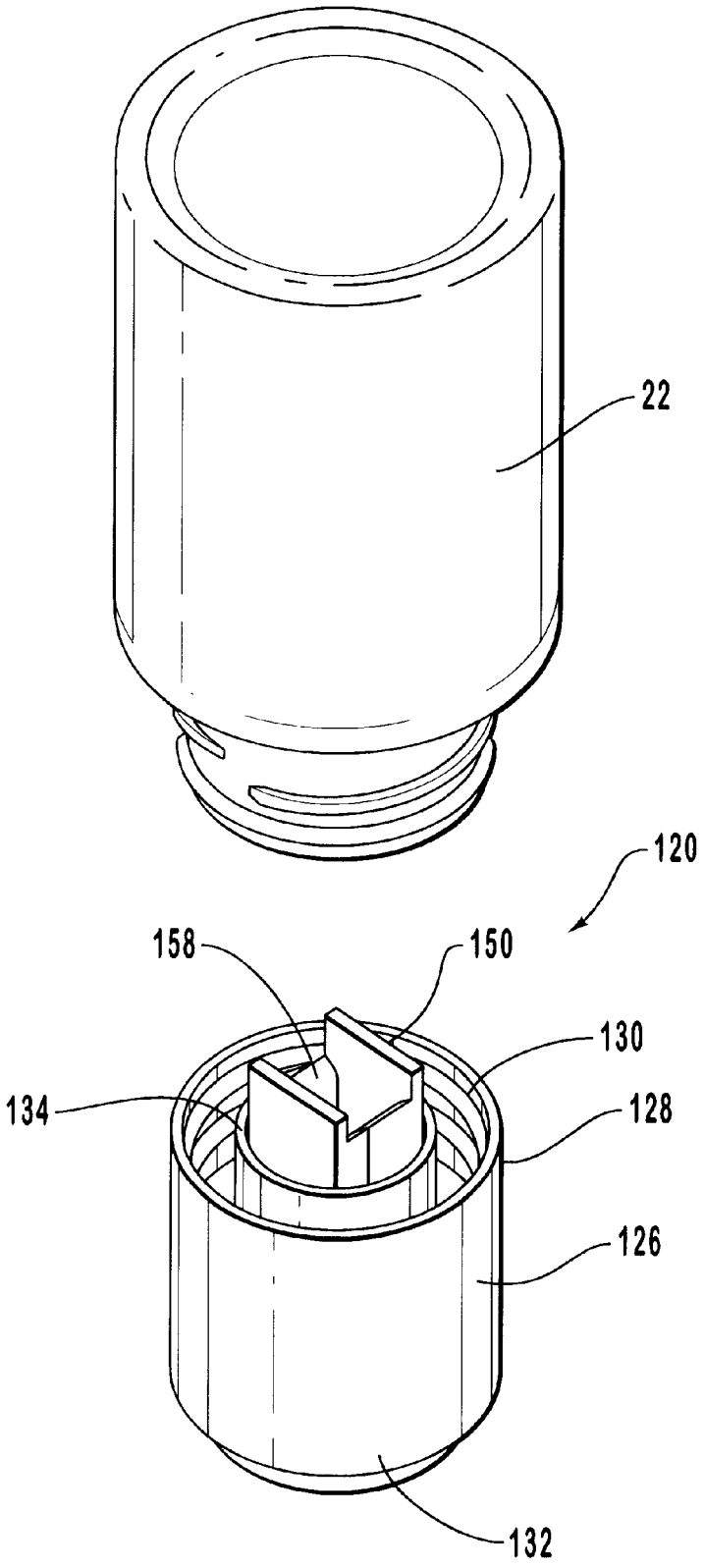
FIG. 4 is a perspective view of an alternate embodiment of the medicament dispensing apparatus of the present invention.
Figure 5A:
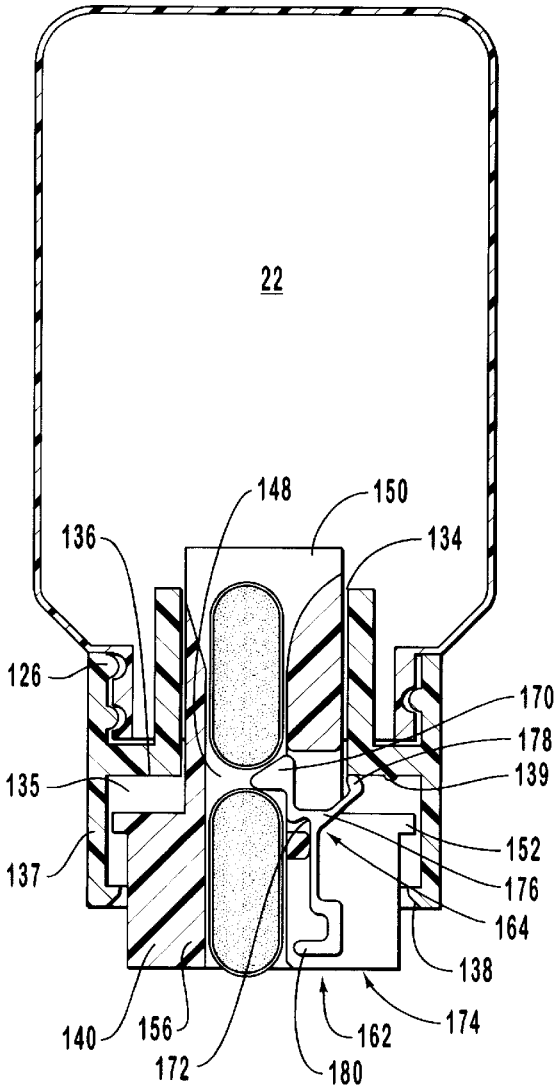
FIGS. 5A–5C are cross-sectional side views of the alternate embodiment of FIG. 4.
Figure 5B:
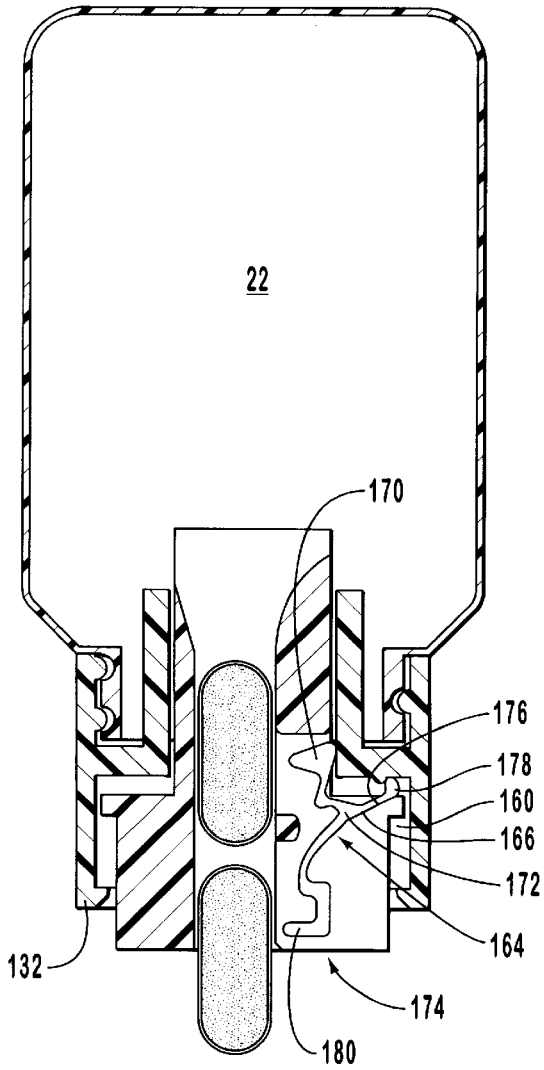

FIGS. 4–6 illustrate another embodiment of a pill dispensing apparatus 120. The majority of the features briefly discussed with respect to pill dispensing apparatus 20 also apply to pill dispensing apparatus 120.

As shown in FIG. 4, pill dispensing apparatus 120 comprises a generally cylindrical housing 126 in cooperation with an agitator 140 and an escapement 162. Housing 126 has a first end 128 configured to cooperate with container 22, including a threaded portion 130 formed to couple with container 22. As depicted, and in more detail in FIGS. 5A 5B, and 5C, housing 126 has a through hole 134 that extends from a first end 128 into an interior chamber 135. Interior chamber 135 has an upper wall 136 with side walls 137 extending from upper wall 136 toward a second end 132 of housing 126. Projecting from the peripheral edge of side walls 137, at second end 132 thereof, is a lip 138. Lip 138 cooperates with agitator 140 to prevent withdrawal of agitator 140 from housing 126 during use.

Upper wall 136 of interior chamber 135 includes a nodule 139 extending from the surface thereof. Nodule 139 is sized to cooperate with escapement 162 to provide an audio identification of the operation of pill dispensing apparatus 120. Therefore, as agitator 140 moves longitudinally within housing 126 escapement 162 cooperates with nodule 139 to produce a noise. In view of the teaching contained herein, one skilled in the art can identify various other configurations of housing 126 that are capable of performing the function thereof.

Figure 5C:
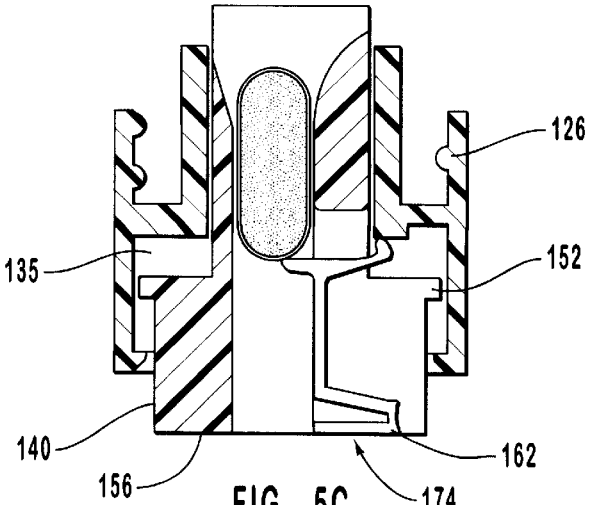

For example, in another configuration upper wall 136 is substantially inclined relative to side walls 137 of housing 126. In another configuration, upper wall 136 has no nodule 139 but includes a step, as shown in FIG. 5C. In yet another configuration, side walls 137 extend substantially perpendicularly from upper wall 136. In still yet another configuration, side walls 137 are formed without lip 138, while being provided with some other structural feature to prevent withdrawal of agitator 140 from within housing 126. In yet another configuration, lip 138 may be formed at any location on side walls 137.

Cooperating with through hole 134 and interior chamber 135 is agitator 140. As shown on FIG. 5A, agitator 140 has a generally cylindrical form with a passageway 148 therethrough. A first end 150 of agitator is formed with a plurality of flanges 158 such that first end 150 has a generally conical-shaped form to aid in directing pills into passageway 148, as shown in FIG. 4. A second end 156 cooperates with escapement 152 such that second end 156 includes a recess 160.

Located between first end 150 and second end 156 is a lip extension 152 that cooperates with lip 138 of housing 126. Lip extension 152 interlocks with lip 138 as agitator 140 is withdrawn from container 22, while preventing excessive withdrawal of agitator 140 from housing 126. As such, lip extension 152 may have various forms so long as lip extension 152 cooperates with lip 138, or an equivalent structure thereof, to prevent withdrawal of agitator 140 from housing 126.

Agitator 140 can have various cross-sectional shapes and dimensions as known by one skilled in the art. For example, circular, ovular, rectangular, square, trapezoidal , or the like.

Coupled to agitator 140 is escapement 162. Escapement 162 is located within recess 160 formed at second end 156 of agitator 140. Escapement 162 comprises a head portion 164 and a base portion 174. Head portion 164 includes a top stop portion 170 that extends into passageway 148 when lip extension 152 is adjacent to lip 138. In communication with top stop portion 170 is a middle portion 172 having an actuation member 166. Actuation member 166 includes a protruding end 178 and capable of flexing under the vertical displacement of agitator 140. Actuation member 176 extends into interior chamber 135 from recess 160. Protruding end 178 therefore contacts upper wall 136 and slidably engages therewith. Protruding end 178 cooperates with nodule 139 to produce the requisite audio identification of agitator 140 movement.

Projecting from middle portion 172 is base portion 174. Base portion 174 has an elongated form with a generally hook-shaped end 180. The elongated nature of base portion 174 provides the flexing capabilities of escapement 162, thereby allowing movement of head portion 154. Hook-shaped end 180 is formed to cooperate with a complementary recess formed in agitator 140 such that escapement 162 is fixably attached to agitator 140.

During operation or use of pill dispensing apparatus 120, agitator 140 is moved along the longitudinal axis of housing 126 such that displacing member 142 of agitator 140 is located within the interior of container 22. As agitator 140 moves along a longitudinal axis of housing 126, protruding end 178 displaces along upper wall 136 of interior chamber 135. The base portion 174 of escapement 162 simultaneously flexes thereby moving top stop portion 170 from within the interior of passageway 148. As this occurs, pills are allowed to move freely through passageway 148 to exit therefrom. If agitator 140 is pushed upward and then released, only one pill is dispensed from passageway 148. As this occurs, pills move freely through passageway 148 to exit therefrom. One pill is dispensed from passageway 148 upon activation of agitator 140. In the event that more pills are desired, agitator 140 is retained in the highest longitudinal position within housing 126 thereby preventing release of head portion 164 into passageway 148.

In another configuration of the present invention, agitator 140 includes an integral escapement 162, as shown in FIG. 5C. Therefore, second end 156 of agitator 140 includes base portion 174.

Figure 6A:
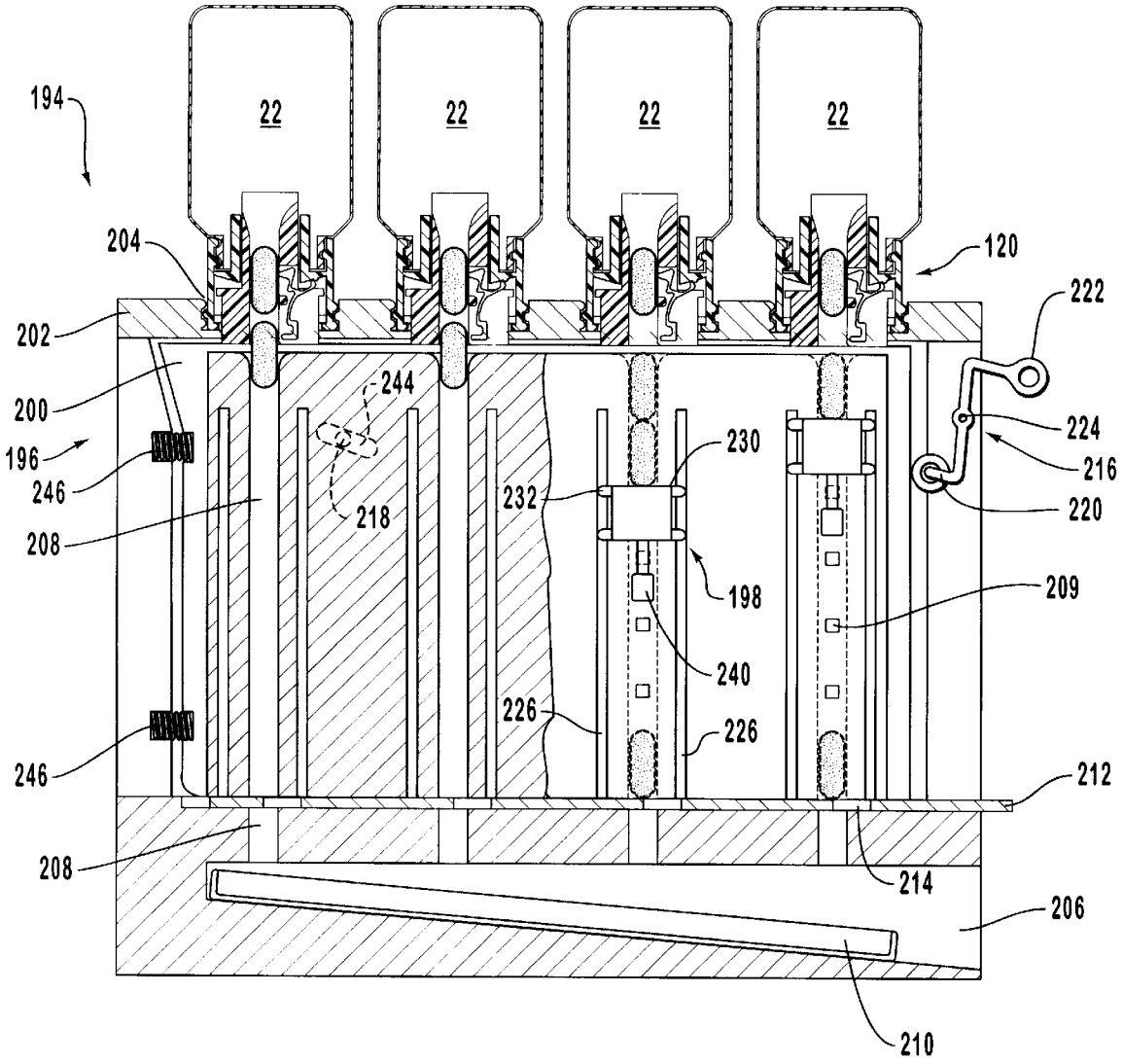
FIG. 6A–6B is cross-sectional side view of a rack-type system incorporating the alternate embodiment of FIG. 4.
Figure 6B:
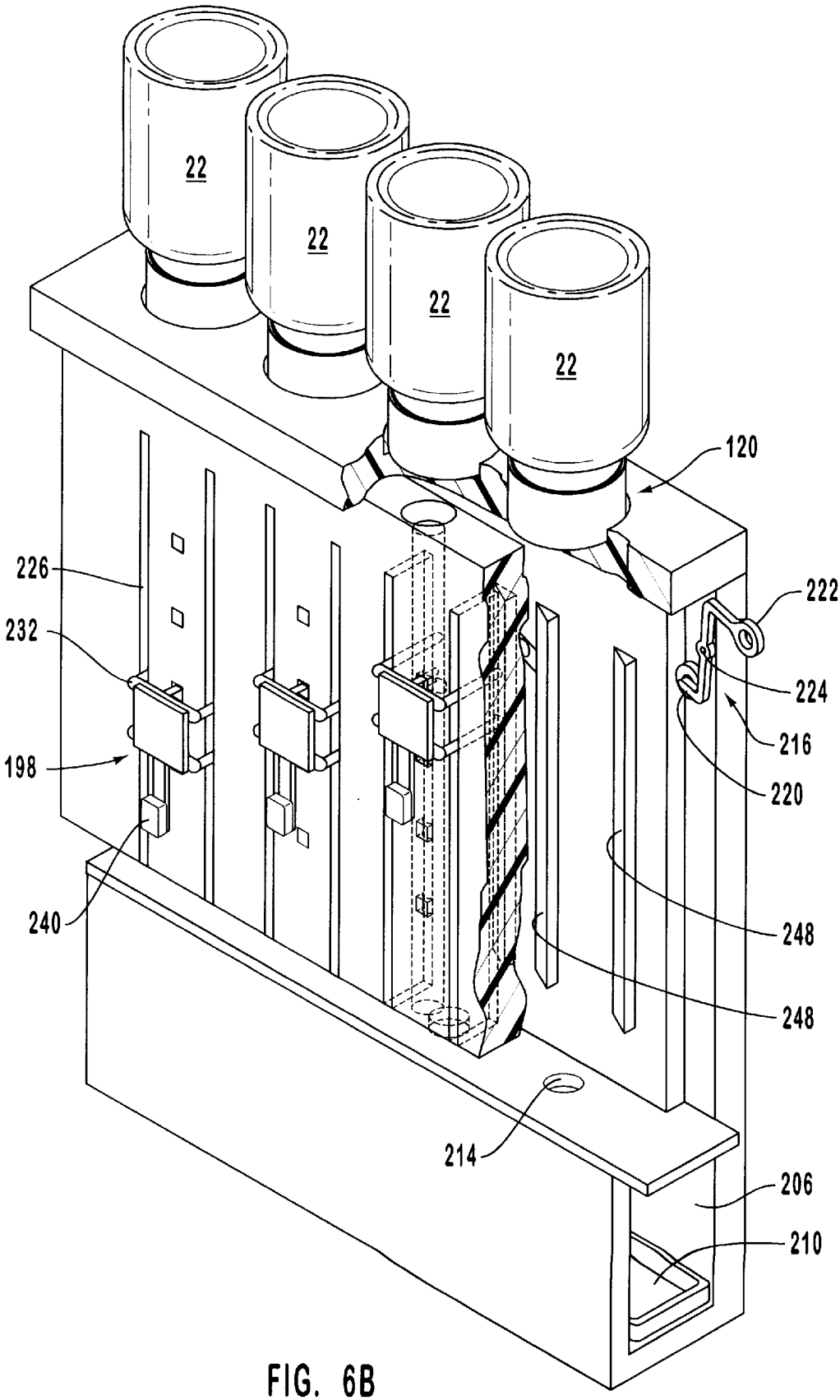

Referring now to FIGS. 6A and 6B, a rack-type system 194 is depicted for dispensing multiple types of pills or numerous quantities of an individual type of pill. The majority of the features described with reference to rack 94 apply to rack 194. In this particular configuration, rack 194 includes a body 196, counters 198, and one or more cam 200. For ease of explanation, some of the reference is made to single elements of body 196, however, it can be appreciated that body 196 may include one or more of the elements defined hereinafter.

Body 196 has a generally I-beam cross-section and is formed with a holding portion 202 at one end thereof. Holding portion 202 includes an aperture 204 that securely retains container 22 and pill dispensing apparatus 120. Holding portion 202 cooperates with cam 200 to allow communication between cam 200 and agitators 140 formed in pill dispensing apparatus 120. In an alternate configuration aperture 204 is threaded, while in yet further configurations various other types of fasteners are provided to connect containers 22 and pill dispensing apparatus 120.

Located opposite to holding portion 202 is a recess 206. Recess 206 is in communication with holding portion 202 by way of a perforated conduit 208. Contained within recess 206 is a removable try 210 having a generally rectangular form, however, various dimensions and cross-sectional shapes of tray 210 are possible. As shown, recess 206 has a tapered profile to incline tray 210 thereby positioning the pills at the downward side thereof. Recess 206 also cooperates with a retention plate 212 that prevents discharge of pills from conduits 208.

Retention plate 212 has a generally planar formed with a port 214 therethrough. Retention plate 212 prevents pills from exiting from conduit 208 towards tray 210 and slidable engages with body 196 and recess 206 to allow a controlled flow of pills through the port 214 as retention plate 212 is removed from recess 206. In an alternate configuration, retention plate 212 is pushed to align port 214 with conduit 208. In this configuration retention plate 212 engages with a biasing spring that locates the one or more ports 214 in misalignment with conduit 208 upon release of retention plate 212. In view of the teaching contained herein, one skilled in the art can identify various other configurations of retention plate 212.

Body 196 further includes a switch 216 and connector member 218. Switch 216 has a generally S-shaped form with a first end 220 in contact with cam 200. Located between first end 220 and a second end 222 is a pivot point 224 about which switch 216 rotates. As switch 216 rotates, first end 220 pushes against cam 200 thereby moving cam 200 both vertically and horizontally towards agitator 140. Switch 216 can therefore have any form known to one skilled in the art to provided the necessary movement of cam 200. For example, switch 216 can include a slider-type mechanism. In another configuration, switch 216 cooperates with a recess within cam 200.

Connector member 218 is located between holding portion 202 and recess 206 and extends from the surface of body 196. Connector member 218 interconnect with cam 200 and aids in guiding the movement of cam 200 towards agitators 140. As such, connector member 218 may have various dimensions and sizes so long as it is capable of cooperating with cam 200. It is preferred that connector member 218 be substantially cylindrical in form.

In general body 196 can have various sizes and dimension as necessary dependent on the number of containers 22 and pill dispensing apparatus 120 provided for in rack 194. Body 196 can be manufactured from various types of material such as metals, composites, plastics, acrylics, polycarbonate, or the like. It is preferred that body 194 or a portion thereof by formed from a transparent material to thereby allow a user to visually identify the pills passing therethrough. It is preferred that body 194 be substantially composed of clear acrylic, polycarbonate.

In communication with conduit 208 are one or more counters 198. Counter 198 has a generally planar member 230 having a slider portions 232 and a stop portion 234 extending from a first surface 236 and a button 240 extending from a second surface 238. Slider portions 232 attaches to body 196 by way of slots 226 located adjacent to conduits 208, while stop portion 234 locates within the perforations of conduits 208 through slot 228. Slider portion 232 allow counter 198 to traverse the length of conduit 208, while stop portion 234 releasably positions counter 198 in communication with one of the perforations 209 formed in conduit 208, thereby preventing passage of the pills therethrough. Button 240 flexibly connects to planar member 230 such that upon depression of button 240 stop portion 234 withdrawn from conduit 208 to thereby allow relocation of counter 198.

Counter 198 is capable of being located at any longitudinal position upon conduit 208, thereby prevent, or allow passage of any number of pills therethrough.

Cam 200 comprise a first cam 240 having a generally rectangular form until one or more cam holes 244 therein. Cam 200 is coupled to body 196 by way of springs 241 that reposition first cam 240 after activation. Cam holes 244 are generally ovular in form and are angularly orientated within cam 200. In general, cam holes 244 cooperate with connector members 218 extending from body 196. Therefore, cam holes 244 may vary in size and dimensions so long as they cooperate with connector members 218.

One or more wedges 248 extend from one surface of first cam 240. Wedge 248 has the requisite size and dimensions to push against one of the top slider portions 234 as cam 200 vertically and horizontally displaces towards agitator 140. As such, wedge 248 forces against slider portion 232 thereby partially withdrawing stop portion 234 from within the interior of conduit 208. By so doing, the pills are allowed to flow through conduit 208 towards retention plate 212. The size and dimensions of wedge 248 is such that stop portion 234 remains within conduit 208, while being sufficiently displaced to allow pills to pass. In light of the teaching contained herein, cam 200 can include other protrusions or mechanisms that cooperate with counter 198. For example, cam 200 can include two cams separated by body 186. Therefore, two cams 200 push against agitator 140.

In operation, a user pushes button 240 of counter 198 to locate stop portion 234 at the desired longitudinal position along conduit 198. Upon activation of switch 216, cam 200 are displace vertically and horizontally towards agitator 140 along a path defined by cam holes 244. As the peripheral edges of cam 200 connect agitator 140 they push agitator 140 into the interior of container 22. Simultaneously, the pills with container 22 are agitated and directed into passageway 148. Due to the movement of agitator 140, escapement 162 is removed from within passageway 148 and the pills flow therethrough into conduit 208. As escapement 162 is moved, one or more wedges 248 extending from cam 200 connect with counter 198 to thereby partially remove stop portion 234 from within conduit 208. Upon removal of stop portion 234 from conduit 208, pills from through conduit 208 to rest against retention plate 212. Agitation continues until the requisite numbers of pills are contained within conduit 208. Once the desired number of pills are contained within body 196, retention plate 212 is manipulated to align port 214 with conduit 208 to allow the pills to fall therethrough to tray 210. Stop portion 234 of counter 198 prevents extra pills from traversing along conduit 208 upon activation of retention plate 212.

It can be appreciated that rack 194 may take various forms in light of the teaching contained herein. For example, in an alternate configuration, a plurality of tubes replaces the one or more conduits of body 196. As such counter 198 will take a different configuration to control and count the number of pills contained therein.

Figure 7:
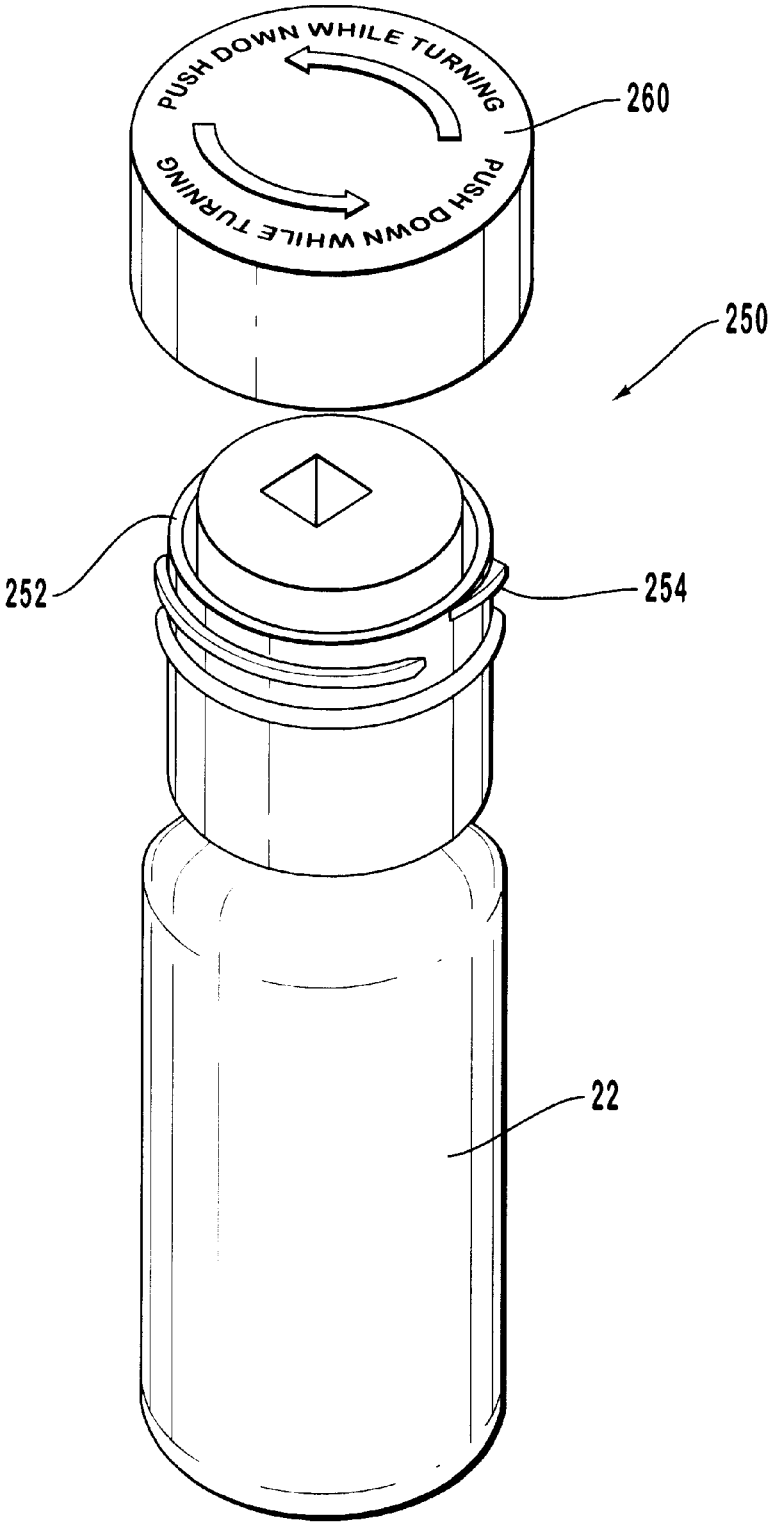
FIG. 7 is a perspective view of another alternate embodiment of the medicament dispensing apparatus of the present invention.

Depicted in FIG. 7 is an alternate configuration of pill dispensing apparatus. The majority of the features described in reference to pill dispensing apparatus 120 apply to pill dispensing apparatus 250. Pill dispensing apparatus 250 includes a child safety cap 260 that releasably attaches to a threaded portion 254 formed in housing 252. Child safety cap 260 prevents access to agitator 140 without first removing child safety cap 260 from housing 252. As depicted, child safety cap 260 is removed be vertically displacing child safety cap 260 towards container 22 and while maintaining vertically displacement rotating child safety cap 260.

In view of the teaching contained herein, one skilled in the art can identify various other configurations of child safety cap 260 that are capable of perform the function thereof. For example, in another configuration, housing 252 has a threaded portion 254 with a segment removed therefrom. Child safety cap 260 includes a protrusion aligned with the removed segment to both remove and replace child safety cap 260. In still yet another configuration, a button must be depressed to allow the child safety cap 260 to be removed.

The present invention may be embodied in other specific forms without departing from the spirit or essential characteristics. The described embodiments are to be considered in all respect only illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A dispensing apparatus for delivering pills, comprising:

(a) a housing member formed to cooperate with a container;

(b) agitating means for moving the pills within said container into a passageway, said agitating means capable of being displaced into an interior of said container, said agitating means comprising a displacement member having an angled portion in cooperation with a dispensing member formed with a passageway therethrough and a conical-shaped first end; and (c) escapement means for allowing at least one pill to exit from said passageway upon activation by the user.

2. An apparatus as recited in claim 1, wherein the apparatus further comprises control means for controlling the displacement of said agitating means within said container.

3. An apparatus as recited in claim 1, wherein said agitating means comprises a displacement member formed with a slot therein, said slot configured to cooperate with a fastener such that the displacement of said displacement member is controlled.

4. An apparatus as recited in claim 1, wherein the apparatus further comprises biasing means for maintaining said escapement means in a closed position during non-use of the apparatus.

5. An apparatus as recited in claim 1, wherein said dispensing member is formed with a recess therein, said recess cooperating with a spring while holding said spring in cooperation with said escapement means to thereby maintain said escapement means in a closed position during non-use of the apparatus.

6. An apparatus as recited in claim 1, wherein the apparatus further comprises a child locking means for prevent dispensing of pills while a locking mechanism is activated.

7. An apparatus as recited in claim 1, wherein said housing is releasably coupled to said container.

8. An apparatus as recited in claim 1, wherein said escapement means comprises a head portion rotatably coupled to said agitating means.

9. An apparatus as recited in claim 1, wherein the apparatus is fixably attached to a rack.

10. An apparatus as recited in claim 9, wherein said rack is formed with an activation member configured to move the apparatus fixably attached to said rack.

11. A pill dispensing apparatus for delivering pills, comprising:

(a) a housing formed to cooperate with a container;

(b) an agitator formed with a passageway therethrough, said agitator being in slidable engagement with said housing and configured to move the pills within said container into said passageway upon substantial vertical displacement of said agitator into said container;

(c) an escapement member in communication with said housing and said agitator, said escapement member being formed to move generally laterally to said passageway and to allow at least one pill to exit from said passageway as said agitator slidably engages with said housing;and (d) a spring in communication with said escapement member, the spring being configured to maintain said escapement member in a closed position during non-use of the apparatus.

12. An apparatus as recited in claim 11, wherein said escapement member comprises a head portion and a handle portion, said head portion formed to prevent movement of pills through said passage.

13. An apparatus as recited in claim 11, wherein said handle portion is formed to manipulate said head portion to control the flow of pills through said passageway.

14. An apparatus as recited in claim 11, wherein said pill dispensing apparatus further comprise a child safety lock.

15. An apparatus as recited in claim 11, wherein said escapement member comprises a head portion and a base portion.

16. An apparatus as recited in claim 15, wherein said base portion is fixably attached to said housing.

17. An apparatus as recited in claim 11, wherein the apparatus is further provided with a controller configured for controlling the substantial vertical displacement of the agitator within the container.

18. An apparatus as recited in claim 17, wherein said controller comprises a slot formed in a side of said agitator in cooperation with a fastener inserted through said housing to be located within said slot.

19. An apparatus as recited in claim 17, wherein said controller comprises an upper wall and a lip formed in said housing in cooperation with a lip extension provided in said agitator.

20. An apparatus as recited in claim 11, wherein said agitator comprises a displacement member and a dispensing member.

21. An apparatus as recited in claim 20, wherein said displacement member has a generally elongated form with an angled portion and a cam.

22. An apparatus as recited in claim 20, wherein said dispensing member includes said passageway therethrough and is provided with a conical-shaped first end to aid in the positioning of pills within said passageway.

23. A pill dispensing apparatus for delivering pills, comprising:

(a) a housing formed to cooperate with a removable container;

(b) a generally cylindrical agitator comprising a generally conical-shaped first end, a recess formed at a second end, and a passageway from said first end to said second end, said agitator being in slidable engagement with said housing and configured to move the pills within said container through said generally conical-shaped first end into said passageway upon displacement of said agitator into said container; and (c) an escapement member in communication with said housing and said agitator, said escapement member comprising a head portion formed with a top stop portion, a middle portion, a protruding portion extending from said middle portion and configured to cooperate with said housing, and a base portion, said escapement member being formed to move generally transversely to the longitudinal axis within said passageway and being configured to allow passage of a pill from said passageway in a controlled manner upon slidable engagement of said agitator with said housing.

24. An apparatus as recited in claim 23, wherein said housing has a generally cylindrical form.

25. An apparatus as recited in claim 23, wherein said pill dispensing apparatus further comprises a child safety lock in the form of a child safety cap configured to coupled to said housing.

26. An apparatus as recited in claim 23, wherein said base portion is fixably attached to said housing while allowing lateral movement of said top stop portion within said passageway.

27. An apparatus as recited in claim 23, wherein said pill dispensing apparatus is fixably attached to a rack.

28. An apparatus as recited in claim 23, wherein said rack is formed with an activation member configured to move said at least one of the pill dispensing apparatus.

29. An apparatus as recited in claim 23, wherein the apparatus further comprises means for creating an audible signal that identifies when a pill is dispensed from the apparatus.

30. An apparatus as recited in claim 29, wherein the creating means comprises a nodule formed on said housing, said nodule cooperating with said escapement member to create the audible signal.

31. An apparatus as recited in claim 29, wherein the creating means comprises a step formed on said housing, said step cooperating with said escapement member to create the audible signal.

32. A pill dispensing system for delivering quantities of pills comprising:

(a) a rack formed with a holding member, said rack comprising a plurality of side members, a backplate, and at least one cam capable of vertically displacing said agitating means;

(b) at least one pill dispensing apparatus for delivering the pills, said pill dispensing apparatus comprising:

(i) a housing member formed to cooperate with a removable container, (ii) agitating means for moving the pills within said container into a passageway, said agitating means capable of being generally vertically displaced into an interior of said container external to said housing, said agitating means comprising a cylindrical member provided with said passageway therethrough; and (iii) escapement means for allowing at least one pill to exit from said passageway upon activation by the user or manipulation of said agitating means.

(c) a controller in cooperation with said at least one pill dispensing apparatus and said rack formed to activate said at least one agitating means of said at least one pill dispensing apparatus.

33. A system as recited in claim 32, wherein the escapement means comprises a head portion and a base portion, said base portion being fixably attached to said agitating means while allowing lateral displacement of said head portion relative to said passageway.

34. A system as recited in claim 32, wherein said at least one cam is capable of generally horizontal displacement.

35. A system as recited in claim 34, wherein said rack is provided with a plurality of conduits configured to numerically represent the number of pills contained therein.

36. A system as recited in claim 35, wherein said plurality of conduits are formed with a plurality of counters.

37. A system as recited in claim 36, wherein said plurality of counters are formed with at least one stop portion configured to be releaseably inserted into the interior of said plurality of conduits.

38. A system as recited in claim 37, wherein said body is provided with a retention plate having ports therein, said retention plate being configured to prevent passage of the pills from said plurality of conduits until said ports are aligned with said plurality of conduits.

39. A system as recited in claim 32, wherein said escapement means comprises:

(a) a head portion formed with a top stop portion and a middle portion; and (b) a base portion.

40. A system as recited in claim 39, wherein said head portion is further provided with a protruding portion extending from said middle portion, said protruding portion configured to cooperate with said housing.

41. A system as recited in claim 40, wherein the apparatus further comprises a child safety lock.

42. A system as recited in claim 40, wherein said apparatus further comprises means for creating an audible signal that identifies when a pill is dispensed from the apparatus.

43. A system as recited in claim 42, wherein said means comprises a nodule formed on said housing, said nodule being configured to cooperate with said protruding portion as said escapement means allows at least one pill to exit from the passageway to create an audible signal that identifies when a pill is dispensed from the apparatus.

* * * * *